United States Patent [19]

Vanhelle

[11] Patent Number: 4,903,472

[45] Date of Patent: Feb. 27, 1990

[54] PROCESS AND APPARATUS FOR THE SPINNING OF FIBER YARNS, POSSIBLY COMPRISING AT LEAST ONE CORE

[75] Inventor: Michel Vanhelle, Badditzenbach, Fed. Rep. of Germany

[73] Assignee: S.A.R.L. Baulip Fil, Paris, France

[21] Appl. No.: 208,834

[22] Filed: Jun. 16, 1988

Related U.S. Application Data

[63] Continuation of Ser. No. 940,508, Dec. 11, 1986, abandoned, which is a continuation-in-part of Ser. No. 904,768, Sep. 5, 1986, abandoned, which is a continuation of Ser. No. 600,363, Apr. 13, 1984, abandoned.

[30] Foreign Application Priority Data

Apr. 14, 1983 [FR] France ..... 83 06125

[51] Int. Cl.[4] ..... D01H 7/92; D01H 15/00; D02G 3/36

[52] U.S. Cl. ..... 57/12; 57/261; 57/280; 57/331

[58] Field of Search ..... 57/5, 7, 12, 13, 14, 57/58.57, 58.59, 261, 263, 278, 279, 280, 285, 286, 292, 331

[56] References Cited

U.S. PATENT DOCUMENTS

| | | | |
|---|---|---|---|
| 1,373,880 | 4/1921 | Garon | 57/225 |
| 2,024,156 | 12/1935 | Foster | 57/225 |
| 2,210,884 | 8/1940 | Chittenden et al. | 57/12 X |
| 2,313,058 | 3/1943 | Francis | 57/210 X |
| 2,504,523 | 4/1950 | Harris et al. | 57/239 |
| 2,526,523 | 10/1950 | Weiss | 57/210 |
| 2,617,603 | 11/1952 | Grisset | 57/279 X |
| 2,717,486 | 9/1955 | Comer | 57/292 |
| 3,017,740 | 1/1962 | Humphreys | 57/12 |
| 3,038,295 | 6/1962 | Humphreys | 57/227 X |
| 3,257,793 | 6/1966 | Abbott | 57/12 |
| 3,264,816 | 8/1966 | Jäggi | 57/12 |
| 3,616,632 | 11/1971 | Reuter et al. | 57/279 |
| 3,811,259 | 5/1974 | Petersen | 57/58.59 X |
| 4,033,102 | 7/1977 | Vanhelle | 57/12 |
| 4,100,727 | 7/1978 | Hamel | 57/12 |
| 4,351,146 | 9/1982 | Faure et al. | 57/12 X |
| 4,414,800 | 11/1983 | Nakayama et al. | 57/236 |
| 4,484,436 | 11/1984 | Nakayama et al. | 57/13 X |
| 4,545,193 | 10/1985 | Tanaka et al. | 57/261 |

FOREIGN PATENT DOCUMENTS

| | | | |
|---|---|---|---|
| 70210 | 1/1983 | European Pat. Off. . | |
| 2133135 | 7/1971 | Fed. Rep. of Germany . | |
| 1546714 | 11/1968 | France . | |
| 2270355 | 12/1975 | France . | |
| 2367129 | 5/1978 | France . | |
| 2429765 | 1/1980 | France . | |
| 2461040 | 1/1981 | France . | |
| 2507634 | 12/1982 | France . | |
| 950821 | 8/1980 | U.S.S.R. | 57/261 |
| 993848 | 6/1965 | United Kingdom . | |

*Primary Examiner*—Joseph J. Hail, III

*Attorney, Agent, or Firm*—Fred A. Keire; Robert F. Kirchner

[57] ABSTRACT

The present invention relates to a process for start spinning or piecing at least two yarns of fibers, which process includes forming strands for start-spinning or piecing by introducing a continuous filament into each roving, false twisting the strands, assembling the strands at a given point of convergence, cutting each filament upstream of its introducing point, removing the filament from the strands and twisting the strands without the filament to a twisted yarn. This process serves to overcome the problem of breaking at the start of the spinning. Also by the present invention, the problem of breaking while twisting the assembled intermediate yarns to a twisted yarn is avoided by introducing a false twisting of the assembled intermediate yarns, supplementing to the false twisting of the intermediate yarns, before the last twisting.

6 Claims, 5 Drawing Sheets

PROCESS AND APPARATUS FOR THE SPINNING OF FIBER YARNS, POSSIBLY COMPRISING AT LEAST ONE CORE

CROSS-REFERENCES TO RELATED APPLICATIONS

This application is a continuation of application Ser. No. 940,508, filed Dec. 11, 1986, now abandoned which in turn is a continuation-in-part of application Ser. No. 904,768 filed 9/5/86, now abandoned which in turn is a continuation of application Ser. No. 600,363 filed 4/13/84, now abandoned. cl BACKGROUND OF THE INVENTION The present invention relates to a process and apparatus for the spinning of fiber yarns, possibly comprising at least one core.

The production of the threads can be effected on numerous spinning systems. Ring-traveler systems, self-twisting systems, free-end systems, braiding systems, etc. are known.

One special type of thread consists of the core threads in which a core thread is wrapped with a sheathing of staple fibers. Methods of producing core threads are described, in particular, in U.S. Pat. Nos. 1,373,880, 2,024,156, 2,210,884, 2,313,058, 2,504,523, 2,526,523, 3,017,740 and 3,038,295.

The production of core threads can be effected on numerous systems of spinning commonly employed for the manufacture of threads from staple fibers. However, particularly in the case of the ring-traveler system, spun core threads generally have the drawback of being limited in speed of production to the speed of the machines used and therefore to the system of twisting employed.

Self-twisted core threads are known from U.S. Pat. No. 4,033,102. An original manner of producing self-twisted core threads is described in French Patent Nos. 7,918,173 and 7,913,995. The advantage of this process is that it requires only unidirectional movements of constant speed. On the other hand, its great drawback is that it imposes sudden, extensive variations in twist, and therefore in tension on the thread, which limit the effectiveness thereof with respect to the speed of production and increase the danger of the sliding of the cover fibers with respect to the core.

French Patent No. 8,111,642 avoids these drawbacks and permits a high speed of production without sliding of the cover fibers with respect to the core and produces, after doubling, a unidirectional torsion of the twist. Its great drawback is that it requires the use of one or more continuous filaments serving as vector for the cover fibers, which may be a drawback in the final product.

The present invention makes it possible to obtain fiber yarns with or without cores with an extremely high speed of production, obtained by the consolidating of the strength of the fiber yarn, preferably at the time when it must withstand stresses.

Conventional spinning processes, such as described in U.S. Pat. Nos. 4,414,800 and 4,484,436, include the following steps:

(a) drafting at least two rovings of fibers to intermediate yarns;

(b) false twisting the intermediate yarns;

(c) assembling the intermediate yarns; and (d) twisting the assembled intermediate yarns to a twisted yarn.

The twisting of the assembled intermediate yarns may be accomplished by winding the assembled intermediate yarns by means of a two-for-one twister to a twisted yarn.

Such conventional processes produce a fiber yarn which primarily has two twisted and assembled intermediate yarns without a core. However, it is also possible that a core may be present.

SUMMARY OF THE INVENTION

The present invention relates to the problem of breaking of the yarn during the spinning process. Breaking occurs particularly in two circumstances:

(1) at the start of the spinning (or the piecing) of the yarn; and (2) during twisting of the assembled intermediate yarns to a twisted yarn.

The present invention is directed to improvements to conventional spinning processes which serve to overcome the problem of breaking.

It is therefore an object of this invention to provide a process for spinning a yarn of fibers by drafting at least two rovings of fibers to intermediate yarns, false twisting the intermediate yarns, assembling the intermediate yarns and twisting the assembled intermediate yarns to a twisted yarn, which process operates in an efficient manner and can be advantageously operated efficiently at high speeds.

Another object of this invention is to provide a spinning process in which breakage of the yarn is decreased.

A further object of this invention is to provide a process for spinning a yarn which produces a yarn of increased strength.

The foregoing and other objects are attained in accordance with the present invention.

In one embodiment, a process is provided for start spinning or piecing at least two yarns of fibers, which process includes forming strands for start-spinning or piecing by introducing a continuous filament into each roving, false twisting the strands, assembling the strands at a given point of convergence, cutting each filament upstream of its introducing point, removing the filament from the strands and twisting the strands without the filament to a twisted yarn.

The present invention provides a valuable advance over the state of the art. When starting a spinning process, such as after a break in the yarn, the strength of the intermediate yarn drafted from the rovings of fibers is not sufficient to allow the process to work correctly. To obviate this problem, applicant has discovered that by adding continuous filament to each roving of fibers upstream of the drawing rolls, the strands of drafted rovings and continuous filaments advantageously run through the drawing rolls and the twister.

The present invention provides a process which can produce a fiber yarn without a core. Therefore, the continuous filament is needed only temporarily and means are provided for its removal. Thus, continuous filament is advantageously cut upstream of its introducing point, that is, upstream or before the drawing rolls. Further, the cut filament can be separated from the yarn by a removing device, such as a suction device, preferably located upstream of the winding roll and final twisting means.

The continuous filament is "continuous" only in the sense that it runs continuously when necessary. Clearly, the continuous filaments are not introduced into the rovings when not necessary and, in any case, are removed before final twisting. Preferably, the final strands which are twisted do not contain the continuous filaments.

A further embodiment of the present invention concerns the problem of breaking while twisting the assembled intermediate yarns to a twisted yarn. By the present invention, this problem of breaking is advantageously avoided by introducing a false twisting of the assembled intermediate yarns, supplementary to the false twisting of the intermediate yarns, before the last twisting.

These advantages are achieved by a process for the spinning of fiber yarns in which at least one roving of fibers is drawn between feed points of said roving and pairs of drawing rolls, upstream of which a continuous filament is introduced and, in accordance with the invention, the strands formed by each roving of fibers and each continuous filament are twisted by a twisting member, preferably a friction-twisting member, by causing them to converge at one and the same point located upstream or downstream of the twisting member. The thread thus formed is passed through a pair of delivery rolls located behind the twisting member, the thread is wound onto a suitable support and the thread thus formed by the strands is possibly doubled on a doubling frame.

This process is such that at a given precise point the thread is imparted sufficient coherence to permit the doubling. Thus the fiber yarn is not broken. The coherence is preferably imparted to the thread between the point of the taking on of twist and the point of the winding of the thread.

The thread which is thus formed in accordance with the invention is doubled on a conventional doubling frame, for instance of ring-traveler, double-twist or double-stage type in order to impart the final twist.

In accordance with another embodiment, the coherence is imparted to the thread by sizing the fibers, namely by the addition of a cohesive product to the fibers, for instance, before fiber rovings are drawn, in particular at the time of the preparation of the rovings or, more preferably, after the twisting of the strands and before the winding up thereof.

In accordance with the invention, the thread which is wound up is such that there is no assembling twist, which is avoided by adjustment of the tension. In the event that such assembling twist should exist due to the irregularities in operation of the twisting member related to the irregularities in mass of the thread, it is a non-uniform random twist or alternate twist or self-twist. It is therefore not uniform either in pitch or in intensity. The invention makes it possible to avoid such a undesired assembling twist of the wound-up thread.

In order to produce a core-less thread, the continuous filament or filaments are cut before the winding is effected. The continuous filament or filaments are preferably cut upstream of the drawing rolls. This constitutes a method of starting manufacture which is in no way limitative and other manners of procedure can be contemplated.

In accordance with one particular embodiment of the invention, at least two rovings of fibers are drawn separately between feed points and pairs of drawing rolls; the continuous threads are fed; they are introduced into said rovings upstream of the different drawing rolls; and the strands formed are caused to converge at a given point of a twisting member. The strands formed are passed through a pair of delivery rolls and the continuous filaments cut, upstream of the drawing rolls, before the winding up of the remaining assembly. The assembly formed by the fibers is then placed on a doubling frame where strength of the thread is assured between the point of winding of the thread on the bobbin and the point of the taking on of twist.

This purpose is also achieved by a device for the spinning of fiber yarns comprising possibly at least one continuous filament and having:

means for producing at least two strands of fibers, means for feeding at least one continuous filament into each strand, means for the false twisting of the strands, preferably by friction, means for regulating the tension of the strands, preferably located downstream of the twisting means, and possibly means for eliminating the continuous filament, winding means, means for twisting the yarn, means imparting sufficient coherence to permit doubling.

Preferably, the coherence means are located between the point of winding of the thread on the bobbin and the point of the assumption of torsion upon doubling.

In accordance with the invention, the thread which is wound has a very special structure. In fact, it is formed of at least two strands placed side by side and having a small residual twist, possibly alternate and very slight, sufficient to assure coherence of the cover fibers on the filament and insufficient to cause the assembling of the two strands by self-twisting in uniform and constant manner.

Finally, the thread after doubling is such that the fibers are all substantially parallel to each other in the axis of each strand with a variation equal to the very slight residual twist present in the thread before doubling, but such that one can dissociate the two strands by untwisting.

There is actually concerned a two-strand thread.

BRIEF DESCRIPTION OF THE DRAWINGS

The invention and the advantages which it provides will, however, be better understood from the embodiments of its reduction to practice which are given below by way of illustration but not of limitation and which are shown in the accompanying drawing, in which.

DESCRIPTION OF THE PREFERRED EMBODIMENTS

Figure 1:
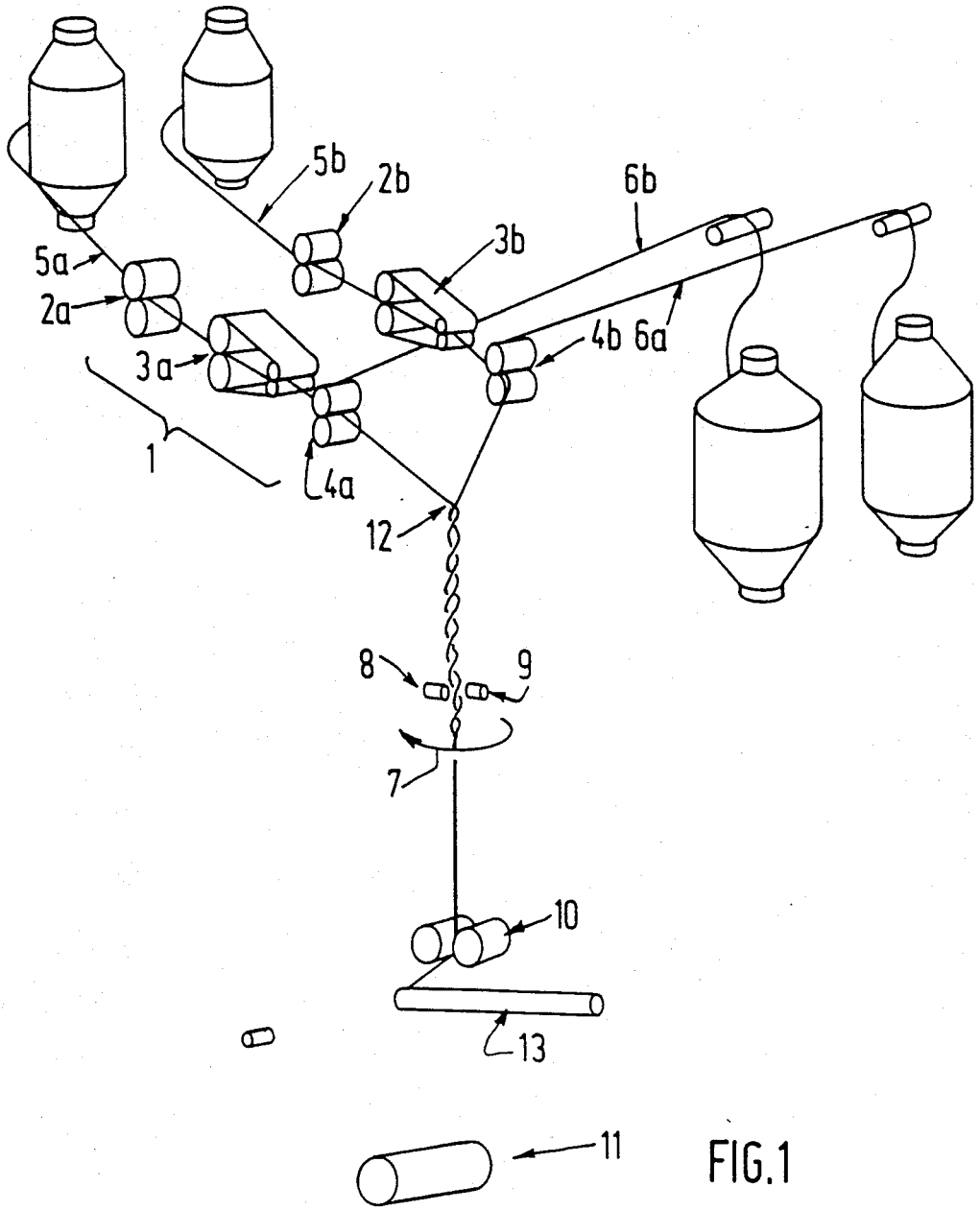
FIG. 1 is a diagrammatic view, in perspective, of a spinning apparatus before the stopping of the continuous filament in the event that the point of convergence is upstream of the twister.

In accordance with the invention, a spinning process is carried out by drawing a roving of fibers 5*a* between a feed point 2*a* and a pair of drawing rolls 4*a*. The drawing system comprises furthermore a pair of drawing belts 3*a*. Parallel to this, a roving of fibers 5*b* is drawn separately by a drawing system comprising a feed point, namely a pair of feed rolls 2*b*, a pair of drawing belts 3*b* and a pair of drawing rolls 4*b*.

Upstream of the drawing rolls (4*a*, 4*b*) a continuous filament (6*a*, 6*b*) is introduced. There are thus formed two strands, each consisting of a roving of fibers and a filament. The strands thus formed are twisted together by a twister 7 and are guided by two guides 8 and 9. The two strands then pass through a pair of rolls 10 before being drawn in by a suction device 13 before eliminating the continuous filaments for instance by cutting, by means of a pair of manual shears, upstream of the drawing rolls.

The continuous filaments which have thus been cut are therefore led away to waste by the suction device 13.

Figure 2:
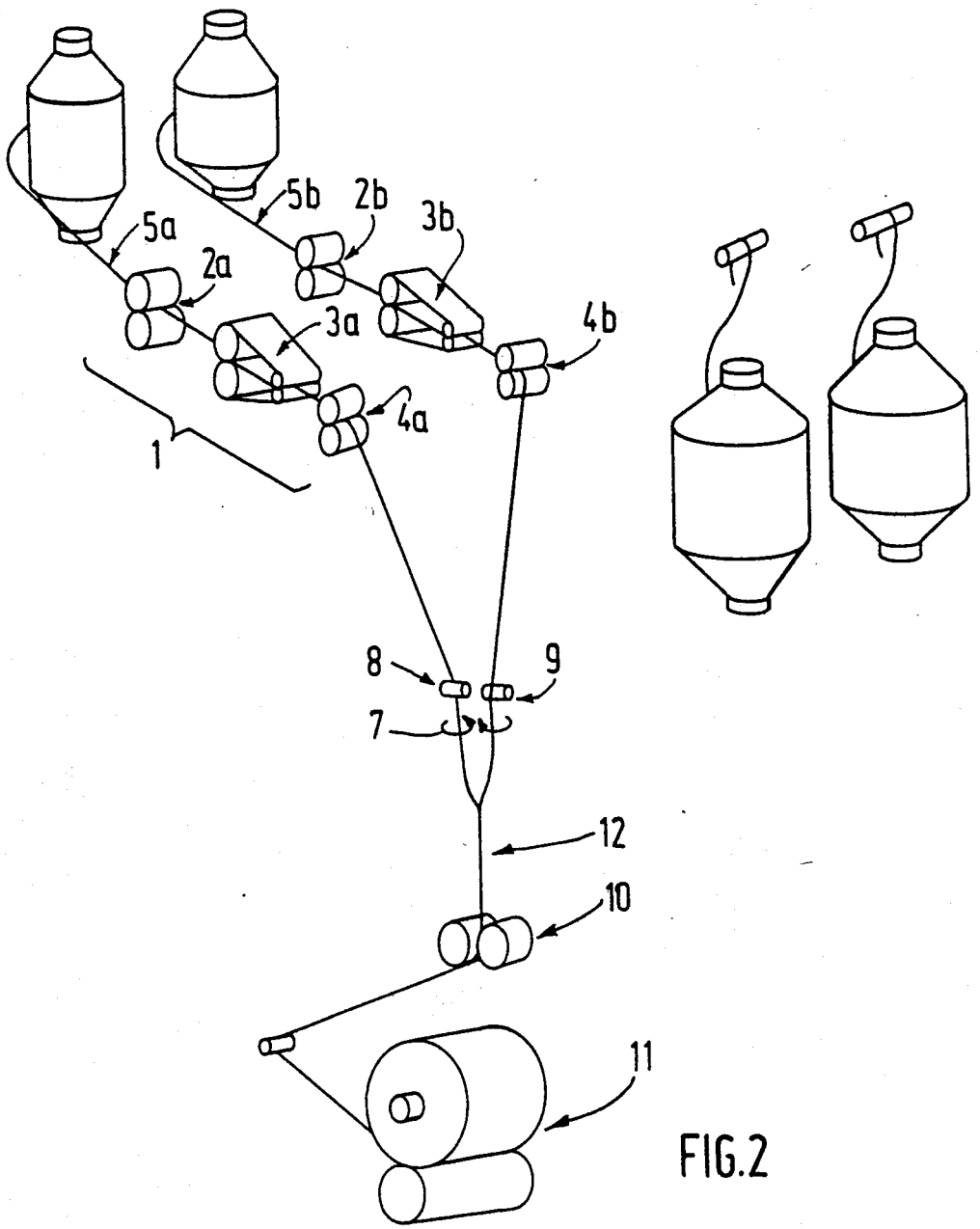
FIG. 2 is a diagrammatic view, in perspective, of an apparatus for the obtaining of a double thread before the placing in torsion and after the cutting of the filament, in the event that the point of convergence is downstream of the twister.

FIG. 2 shows the spinning device after the cutting of the filaments, when the yarn of fibers is wound on a roll 11.

It is important to have a number of fibers in sufficient cross section relative to the coherence of the fibers, the cleanness of the roving and the tension between the drawing rolls 4 and the delivery rolls 10. With respect to the coherence between the fibers, it may be of interest to add to the fibers, at the time of the preparation of the rovings, a size which increases this coherence between the fibers, for instance, a paraffin size or a size containing colloidal silica. This also has the effect of facilitating the doubling.

In the event that the point of convergence is upstream of the twisting member, it is also important to regulate the tension between the drawing rolls and the delivery rolls 10 in such a manner as to have a suitable distance h between the drawing rolls 4 and the point of convergence 12 of the threads, relative to the twist imparted and the speed of travel. In fact, a twist is present in each of the individual strands between the point of convergence 12 of the strands and the point where the strand is grasped last by the drawing rolls 4, but this twist is not incorporated in the resultant thread. This twist is present in the strands prior to the convergence in an equilibrium amount which depends on the geometry of the system and the spinning parameters. This state of affairs described above may, in practice, be modified. In fact, irregularities being present at random in the strands, a part of the twist is incorporated in strands in a randomly varying manner. Such a twist is, however, of slight intensity.

If the tension is too little, then too little torsion is present in the strand between the drawing rolls 4 and the point of convergence 12, which results in losses of fibers at the outlet of the drawing rolls 4, as a result of poor interlocking of the fibers. For example, excellent results have been obtained with a speed of 215 meters per minute with a draw, between the drawing rolls 4 and the delivery rolls 10, of 1.53% and a thread of 2×25 tex composed of 45% wool of 27 microns and 55% polyester of 3 denier. Thus, the difference in speed between the drawing rolls 4 and the delivery rolls 10 is adjusted as a function of the spinning parameters and the speed of travel. If the tension, on the other hand, is too great, the thread is excessively tensioned, resulting in the risk of breakage.

In the event that friction-twisting members are employed which assure both a component of twist and a component of advance of the thread, it may be of interest to adjust the tension of the thread by varying this component of advance, independently of the adjustment of the tension between the delivery and drawing rolls. For example, when two endless crossed belts are used, this adjustment is effected by variation of the angle of the two belts.

By the present invention, the problem of breaking while twisting the assembled intermediate yarns to a twisted yarn is advantageously avoided. When the yarn of fibers is at the stage of the doubling, its strength is, in general, too slight to permit operation without problems and the thread frequently breaks between the point of winding of the thread on the bobbin and the point of the assumption of twist.

Now it has been found that a very slight additional coherence was sufficient to assure the winding of the thread. As a function of the initial coherence of the fibers, a simple cohesive sizing may be sufficient. This cohesive product may be added to the fibers either at the time of the preparation of the rovings or at the location of the spinning machine, between the strand twisting member and the winding member.

In cases in which this is not sufficient or in cases in which sizing is not to be effected, it has been found that the addition of a few turns of twist, by means of a false twisting device, made before the final twisting was sufficient to assure a good winding.

False twisting devices are known. They may be rotary or operate by friction. They may be static and a single winding on a rod may assure a twisting by rolling upstream of the rod when pulling on the thread, provided that the angle of the thread with respect to the rod, the diameter of the rod as a function of the diameter of the thread, as well as the pitch of the thread on the rod and the coefficient of friction of the material of the rod are properly selected.

Figure 3:
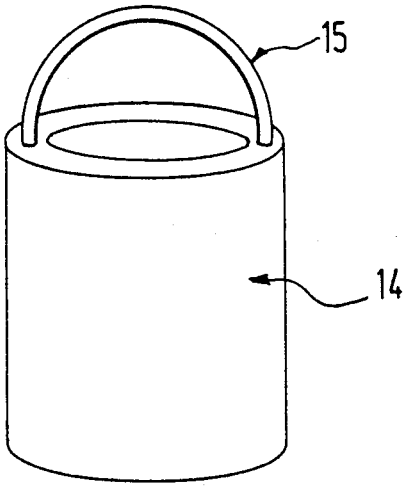
FIG. 3 is a perspective view of a device which makes it possible to obtain strength of the yarn between the point of winding of the yarn on the bobbin and the point of assumption of torsion of a doubling frame.

The example of FIG. 3 is a device which satisfies these requirements. It consists of a body 14 of light material which supports a rod 15 having the form of a semicircle arranged on the upper part of the body 14.

Figure 4:
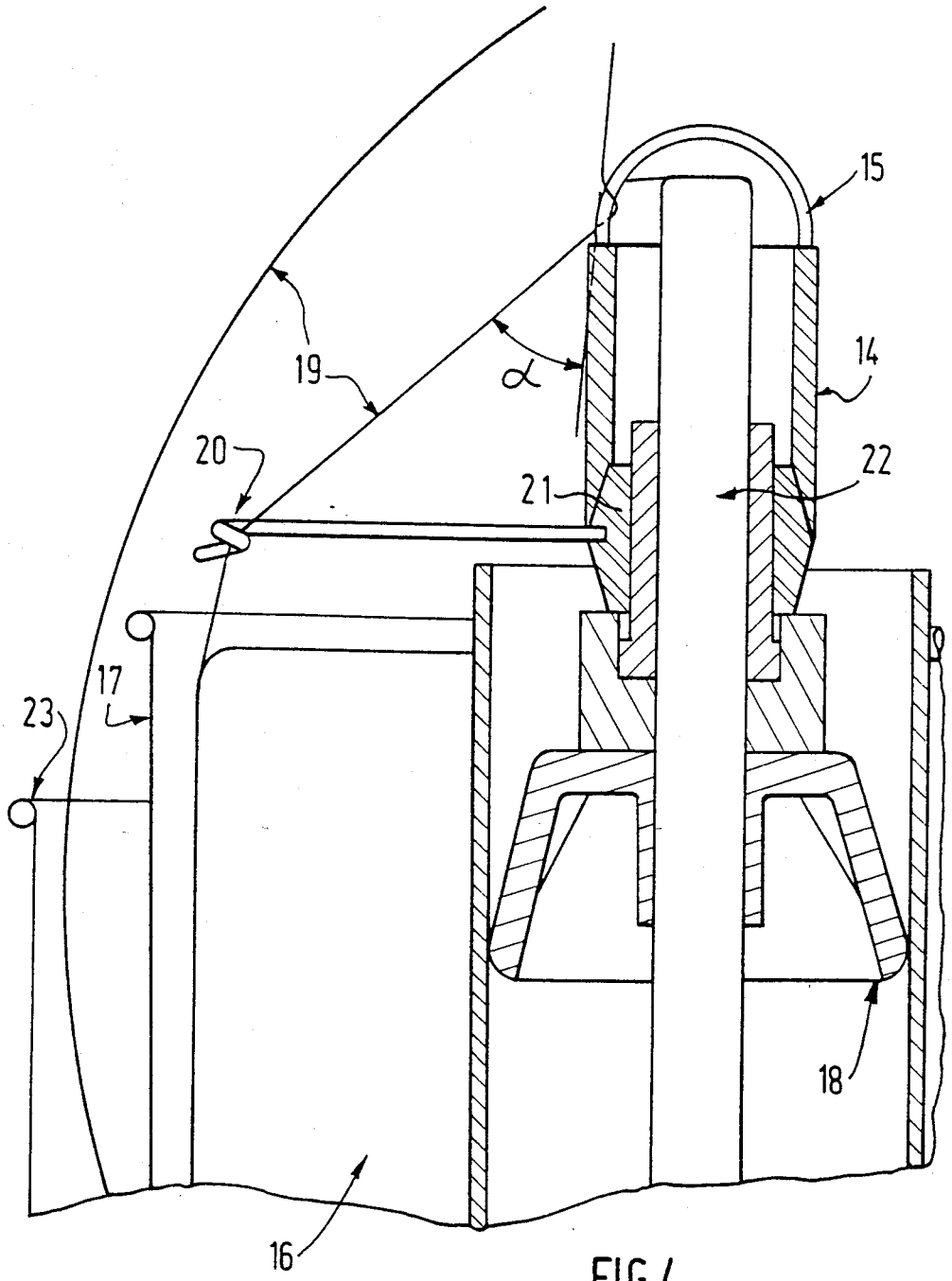
FIG. 4 is a sectional view through the device of FIG. 3, mounted on the winding reel of a double-twist doubler.

The use of the device of FIG. 3 will, however, be better understood from FIG. 4 which shows a cross section through a double-twist doubling spindle in which the bobbin of thread 16 is placed on the pot 17 where it is centered by the centerer 18. The unwinding thread 19 upon leaving the bobbin passes through the eye 20 of the winding reel 21. The thread is then wound on the rod 15 which is supported by the body 14, itself fastened by any means (not shown) on the reel 21. After having effected a certain number of turns, the thread returns into the body of the extender 22 where it will receive the first turn of twist imparted by the torsion disk (not shown) in order then to pass between the pot 17 and the anti-balloon wire 23 where it receives the second turn of twist before being wound on a bobbin (not shown).

In general, in a double-twist doubling machine, the tension of the thread and therefore the number of winding turns on the torsion disk is adjusted by a spring piston, a torsion blocker, not shown, which is located in the extender 22.

In the case of the use of the device according to the invention it is necessary either to remove this piston and thus the twist moves back to the rod 15, or to have a distance between this piston and the rod 15 which is less than the length of the fibers.

When using the device, the tension of the thread is adjusted by varying the following parameters:

number of turns of winding of the thread 19 on the rod 15;

diameter of the rod 15;

coefficient of friction of the material of the rod 15;

angle alpha formed by the thread 19 and the rod 15 at the time when the thread arrives in the rod.

One can vary the rotation of the reel 21 by conventional means, for instance its weight, its coefficient of friction, etc. One can, as in the case of a conventional double-twist doubling machine, vary the force of the spring of the torsion blocker, in the event that one is used.

For example, good results have been obtained with the thread of 2×25 tex described previously on a double-twist doubling frame with a spindle speed of 11,000 rpm and a twist of 371 turns per meter, namely a developed length of 59.2 meters per minute, using the device described in FIG. 4 in which the thread made one turn on a spring steel rod of 0.5 mm diameter, without using a twist blocker.

Good results were obtained with a thread of 2×33 tex one of the strands of which is formed of a filament of 300 denier of bright triacetate, without fiber coverage and the other strand is formed of 100% acrylic fibers dull, 3 denier, without filament. The assembly being twisted to 260 turns of spindles at a double-twist spindle speed of 10,000 rpm using the device described in FIG. 4 in which the thread 19 made two winding turns on the rod 15 which had a diameter of 0.25 mm, and without using torsion blocker.

Figure 5:
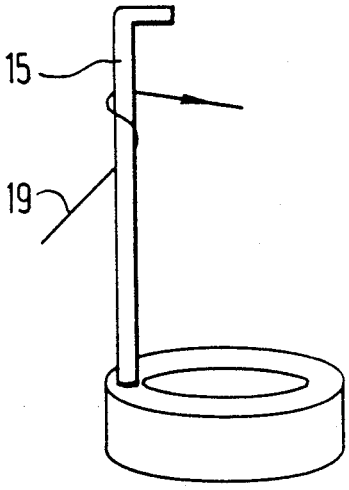
FIG. 5 is a perspective view of a variant of the device of FIG. 3.

A variant of the device is shown in FIG. 5, in which the thread is wound on a straight rod.

As a function of the threads to be doubled, one can have different angles between the rod and the vertical so as to change the angle of the thread with respect to the rod in order to vary the intensity of false twist.

The examples of forms of the device described are given by way of illustration and not of limitation. The only requirement is that there is a winding of the thread on the rod with a suitable angle of the thread with respect to the rod. More generally, one uses any device which permits false twisting between the winding-on and the assumption of twist, which permits the winding of the thread upon the twisting without it breaking due to its small strength.

Figure 6:
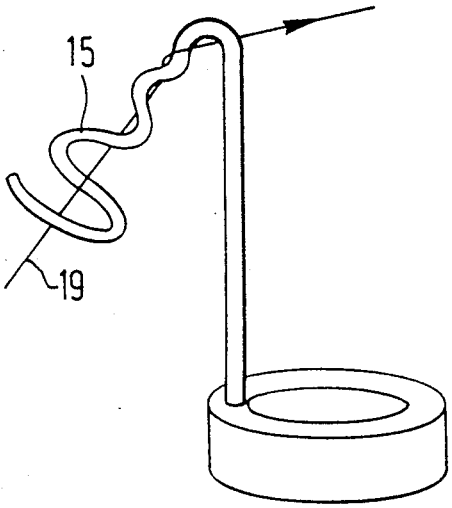
FIG. 6 is a perspective view of another variant of the device of FIG. 3.

Another variant of the device is shown in FIG. 6 where the rod is spiraled in the shape of a cone.

Figure 7:
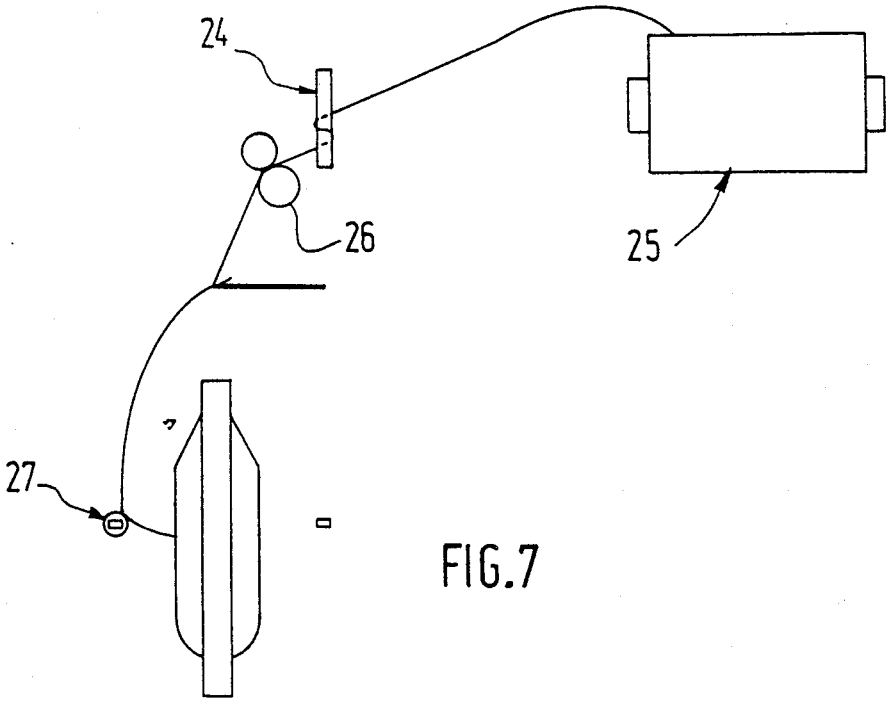
FIG. 7 is a diagrammatic view of the device of FIG. 5, mounted on a ring-traveler doubling frame.

In the event that doubling is effected by a different doubling technique, for instance with a ring doubling frame as shown in FIG. 7, it will be sufficient to place a rod 24 between the bobbin 25 and the delivery rolls 26 in order to have a certain angle of the thread with respect to the rod so as to impart sufficient false twist for the winding, in order to obtain a distance between the rod and the delivery rolls less than the length of the fibers. In this case the tension is determined by the weight of the traveler 27.

In the event that doubling is effected by the double-step doubling technique, it will be sufficient to adapt the device of FIG. 7 to the first doubling assembling step.

Thus, in accordance with the invention one obtains a yarn of fibers comprising at least two strands which does not have any discontinuity such as knots, splices or stoppage points and which permits the production of bobbins of thread of large weight, for instance of a weight of at least 1 kg in the case of fine threads, for instance of about 10 tex, and bobbins of thread of at least 10 kg in the case of thick threads, for instance threads of about 1000 tex.

Figure 8A:
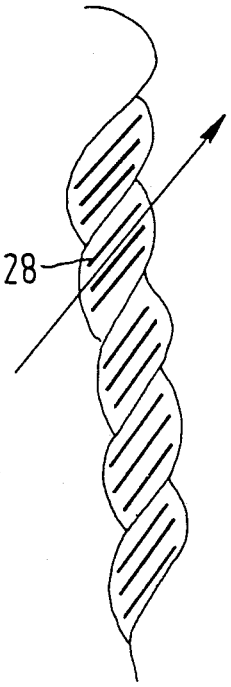
FIG. 8A is a view of the thread after doubling in accordance with the invention.
Figure 8B:
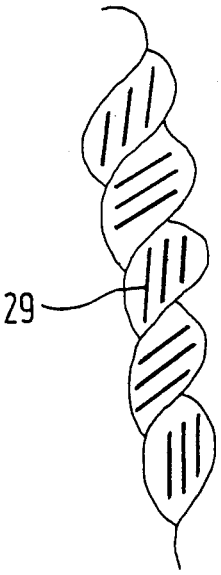
FIG.8B PRIOR ART
FIG. 8B is a view of a thread of the prior art.

One such thread is shown in FIG. 8A. As can be seen, the fibers 28 are substantially much more parallel to each other than the fibers 29 of a thread of the prior art, all other things being equal.

I claim:

1. A process for start-spinning or piecing at least two yarns of fiber, which comprises drawing at least two rovings of fibers between deed points of said roving and pairs of drawing rolls, introducing a continuous filament into each roving upstream of the pairs of drawing rolls to form strands for start-spinning or piecing, false twisting the strands, assembling the false-twisted strands at a given point of convergence, cutting each filament, removing the assembled strands with the cut filament from the process, false twisting the assembled strands without the filament and twisting the false-twisted assembled strands without the filament to a twisted yarn.

2. A process according to claim 1, wherein each filament is cut upstream of its introducing point.

3. A process according to claim 1, wherein the assembled strands pass between delivery rolls, and tension is imparted to the strands by operating the drawing rolls at a slower speed than the delivery rolls.

4. A device for the spinning of yarns of fibers containing at least two strands, which comprises:

means for producing at least two strands formed of at least one roving of fibers and at least one continuous filament, said producing means comprising a pair of rolls for feeding a strand of fibers, a pair of belts for drawing the strand, a pair of rolls for drawing the strand, and a condenser located between the drawing belts and the drawing rolls;

means for eliminating the continuous filament, said eliminating means comprising shears;

means for false twisting the strands;

means for adjusting the tension of the strands, located downstream of the twisting means, said adjusting means comprising delivery rolls whose speed is adjusted with respect to the speed of the drawing rolls;

means for twisting the stands to form a thread;

means for winding the thread;

means for doubling the thread formed by the strands, said doubling means comprising a doubling frame;

means for increasing the strength of the thread between winding of the thread on a bobbin and twisting of the thread upon the doubling of the thread, said increasing means comprising false twisting by winding the thread around a rod forming a certain angle with the thread and located between the winding of the thread on the bobbin and the twisting of the thread at a distance from a point of assumption of twist less than the length of the fibers.

5. A device according to claim 4, which comprises at least two means for the production of strands.

6. A device as claimed in claim 4, wherein said means for false twisting false twists said strand by friction.

* * * * *